US009805571B2

(12) United States Patent
Leatherby

(10) Patent No.: US 9,805,571 B2
(45) Date of Patent: Oct. 31, 2017

(54) SMOKE ALARM MOUNTING AND DISMOUNTING SYSTEM AND METHOD

(71) Applicant: Holy Smoke Alarms Pty Ltd, Merrylands (AU)

(72) Inventor: Darin Vincent Leatherby, Merrylands (AU)

(73) Assignee: Holy Smoke Alarms Pty Ltd., Merrylands, New South Wales (AU)

( * ) Notice: Subject to any disclaimer, the term of this patent is extended or adjusted under 35 U.S.C. 154(b) by 0 days.

(21) Appl. No.: 14/911,269

(22) PCT Filed: Apr. 24, 2014

(86) PCT No.: PCT/AU2014/000467

§ 371 (c)(1),
(2) Date: Feb. 10, 2016

(87) PCT Pub. No.: WO2014/121349

PCT Pub. Date: Aug. 14, 2014

(65) Prior Publication Data

US 2016/0189512 A1 Jun. 30, 2016

(30) Foreign Application Priority Data

Aug. 27, 2013 (AU) ..... 2013903247

(51) Int. Cl.
*G08B 17/12* (2006.01)
*G08B 17/10* (2006.01)
*G08B 17/113* (2006.01)

(52) U.S. Cl.
CPC ..... *G08B 17/10* (2013.01); *G08B 17/113* (2013.01)

(58) Field of Classification Search
CPC .... G08B 17/113; G08B 17/107; G08B 17/10; G08B 17/11; G08B 29/26; G01N 33/0031; H02B 1/04
USPC .... 340/577, 691.1, 541, 584, 628, 578–579, 340/602, 643, 691.6, 825.36, 286.05, 340/291–292
See application file for complete search history.

(56) References Cited

U.S. PATENT DOCUMENTS 6,460,364 B1 * 10/2002 Tufo ..... F24F 11/0086 62/285
6,979,260 B2 * 12/2005 Liu ..... F23L 17/14 454/251
7,028,685 B1 * 4/2006 Krecke ..... E04B 1/74 126/620
2003/0227389 A1 * 12/2003 McGreal ..... G08B 17/10 340/628

(Continued)

OTHER PUBLICATIONS

Extended European Search Report for European Counterpart application.

*Primary Examiner* — Daniel Previl
(74) *Attorney, Agent, or Firm* — Benjamin Mark Snitkoff

(57) ABSTRACT

A method of mounting and dismounting a smoke alarm from a supporting element mounted to an overhead surface; said method including the steps of, inserting an elongate implement into an opening provided in a body of the smoke alarm, and applying a force via the elongate implement so as to detach the body of the smoke alarm from the supporting element, and wherein the elongate implement is applied by a user standing on a floor surface below the overhead surface.

13 Claims, 8 Drawing Sheets

(56) References Cited

U.S. PATENT DOCUMENTS

| | | | | |
|---|---|---|---|---|
| 2007/0069912 | A1* | 3/2007 | Kjerrumgaard | G08B 17/113 340/691.1 |
| 2010/0052903 | A1* | 3/2010 | Tiwari | G08B 25/003 340/541 |
| 2011/0179732 | A1* | 7/2011 | Ermer | B08B 15/00 52/236.3 |
| 2011/0291843 | A1* | 12/2011 | Andersen | G08B 17/06 340/584 |

* cited by examiner

SMOKE ALARM MOUNTING AND DISMOUNTING SYSTEM AND METHOD

TECHNICAL FIELD

The present invention generally relates to arrangements for accessing smoke alarms mounted to an overhead surface and methods for retaining and releasing a smoke alarm from a supporting element, including a vacuum operated locking device for connecting a smoke alarm to the supporting element.

BACKGROUND

Locking devices are known devices for securing components to one another. The most common use is retaining doors in a closed position, however many other examples exist including securing components of an assembly together. The present invention particularly relates to locking devices used in smoke alarms, either for retaining a protective cover or for retaining the smoke alarm itself to a ceiling, wall, or other mounting point, as well as methods for mounting and demounting a smoke alarm.

Smoke alarms require periodic access, such as for replacing batteries or for cleaning. As they are generally mounted on ceilings, gaining access can be difficult, particularly in older style homes where ceilings may be very high. This poses a safety risk as inexperienced people using ladders in their homes may fall. An alternative risk is that the smoke alarms will be neglected due to the difficulty of access, resulting in malfunction due to flat batteries not being replaced or dust obstructing required openings.

It is an object of the present invention to address or ameliorate some of the above disadvantages.

The reference in this specification to any prior publication (or information derived from it), or to any matter which is known, is not, and should not be taken as, an acknowledgement or admission or any form of suggestion that prior publication (or information derived from it) or known matter forms part of the common general knowledge in the field of endeavour to which this specification relates.

Notes

The term "comprising" (and grammatical variations thereof) is used in this specification in the inclusive sense of "having" or "including", and not in the exclusive sense of "consisting only of".

The above discussion of the prior art in the Background of the invention, is not an admission that any information discussed therein is citable prior art or part of the common general knowledge of persons skilled in the art in any country.

SUMMARY OF INVENTION

According to one example aspect, there is provided a locking device for releasably securing a first component to a second component, wherein the locking device can be moved to a released position by providing a region of low air pressure proximal to a first opening of the first component.

According to another example aspect, the first component further includes a second opening, wherein a conduit is configured to provide fluid communication between the first and second openings, and a pin is located at least partially inside the conduit.

According to another example aspect, the pin protrudes from the second opening when the pin is in an extended position and the locking device is in a locked position.

Preferably, the pin is more substantially within the conduit when the pin is in a retracted position and the locking device is in a released position.

According to another example aspect, the second component includes a recess, wherein the pin is at least partially inside the recess when the locking device is in the locked position.

According to yet another optional aspect, the pin can be moved from the extended position to the retracted position by providing the region of low air pressure.

Preferably, the pin can foe moved from the retracted position to the extended position by gravity.

In accordance with other optional embodiments, provided by way of example only, the pin is biased towards the extended position by a biasing means.

In other particular, hut non-limiting, example forms: the biasing means includes one or more magnets; the biasing means includes one or more springs.

Preferably, an outside surface of the first device is configured so that the region of low air pressure can be provided by a vacuum cleaner.

In another particular, but non-limiting, example form, the first component includes one or more additional said locking devices.

Preferably, the first component is a smoke alarm.

In another form, the first and/or second component is a door.

According to another example aspect, there is provided a smoke alarm that is secured using a locking device substantially as herein described.

According to yet another example aspect, there is provided a method of releasably securing a first component to a second component using a locking device, the first component including a first opening, wherein the method of releasing the first component from the second component includes placing a vacuum cleaner proximal to the first opening.

In a further broad form of the invention, there is provided a method of mounting and dismounting a smoke alarm from a supporting element mounted to an overhead surface; said method including the steps of:

b. inserting an elongate implement into an opening provided in a body of the smoke alarm, c. applying a force via the elongate implement so as to detach the body of the smoke alarm from the supporting element, and wherein the elongate implement is applied by a user standing on a floor surface below the overhead surface.

Preferably, the force is a low air pressure force; the elongate implement being a wand or wand attachment of a vacuum cleaner.

Preferably, the low air pressure force acts to release a retaining mechanism connecting the smoke alarm to the supporting element.

Preferably, the retaining mechanism includes retractable pins extending from the body of the smoke alarm to engage with corresponding recesses in the supporting element; the pins being retracted into a non-engaging position when the low air pressure force is applied to the opening.

Preferably, the low air pressure force secures the smoke alarm to an outer end of the wand or wand attachment sufficient to pull the smoke alarm free from a flexible annular retaining ring of the supporting element affixed to the overhead surface by applying a downward force to the wand.

Preferably, an outer end of the wand or wand attachment is of rectangular cross section; the opening in the body of the smoke alarm being of similar rectangular cross section; the outer end of the wand or wand attachment inserted into and engaging with the opening so as to release the smoke alarm from a bayonet type connection by sequentially applying a turning force and a downward force to the wand.

Preferably, the force is a downward force; the elongate implement being a handle of a cleaning device provided at an outer end with a threaded stud; the threaded stud engaging with a corresponding thread of a socket accessed through the opening.

Preferably, the force is a sideways force to disengage a magnetic plate at the upper surface f the smoke alarm from a magnetic plate comprising the retaining element.

Preferably, the magnetic plate of the retaining element is adhesively secured to the overhead surface.

In another broad form of the invention there is provided a smoke alarm mounted to an overhead surface; the smoke alarm comprising a retaining element and a body portion; the body portion provided with an opening for insertion of the end of an elongate implement into the body portion.

Preferably, the opening comprises a cylindrical socket.

Preferably, the opening comprises a rectangular sectioned socket.

Preferably, the opening comprises a threaded socket.

Preferably, the elongate implement is a wand or wand attachment of a vacuum cleaner; a partial vacuum provided by the vacuum cleaner when the wand or wand attachment is inserted into the opening acting to change a retaining mechanism connecting the smoke alarm body to the retaining element from a retaining state to a released state.

Preferably, the body portion includes at least one conduit in communication with the opening; a pin located in the conduit extending from the conduit to engage with the retaining element when the pin is in the extended state; the pin being retracted into a non engaged state when low air pressure is applied to the opening.

Preferably, the partial vacuum provides sufficient attachment of the wand or wand attachment to the body portion of the smoke alarm to allow dismounting of the body portion from the supporting element to bring the body portion within reach of a user standing on a floor surface below the mounted location of the smoke alarm.

Preferably, the body of the smoke alarm is retained by the supporting element through a bayonet connection; rotation and downward movement of the wand of a vacuum cleaner fitted with a rectangular section wand attachment engaged with the rectangular sectioned socket disconnecting the body portion of the smoke alarm from the supporting element.

Preferably, the elongate implement is a handle of cleaning or other household devices; the handle provided with a threaded stud at an outer end of the handle; the thread of the threaded stud conforming to the thread of the threaded socket.

Preferably, the body portion of the smoke alarm is provided with an annular flexible ring; the supporting element provided with an outwardly projecting annular flange; the body of the smoke alarm supported by engagement between the annular flexible ring and the outwardly projecting annular flange.

Preferably, the supporting element is provided with an inwardly projecting annular flexible ring; the body of the smoke alarm provided with a projecting annular flange; the body of the smoke alarm supported by engagement between the annular flexible ring and the outwardly projecting annular flange.

Preferably, a downward force applied to the elongate element when the threaded stud is engaged in the threaded socket, disengages the smoke alarm body from the supporting element.

Preferably, the supporting element comprises a magnetic plate affixed to the overhead surface; an upper surface of the body portion of the smoke alarm provided with a magnetic plate conforming to the magnetic plate of the supporting element; the body portion of the smoke alarm supported from the supporting element by magnetic attraction, Preferably, the supporting element is affixed to the overhead surface by double sided adhesive tape.

BRIEF DESCRIPTION OF DRAWINGS

Embodiments of the present invention will now be described with reference to the accompanying drawings wherein.

DESCRIPTION OF EMBODIMENTS

Figure 1A:
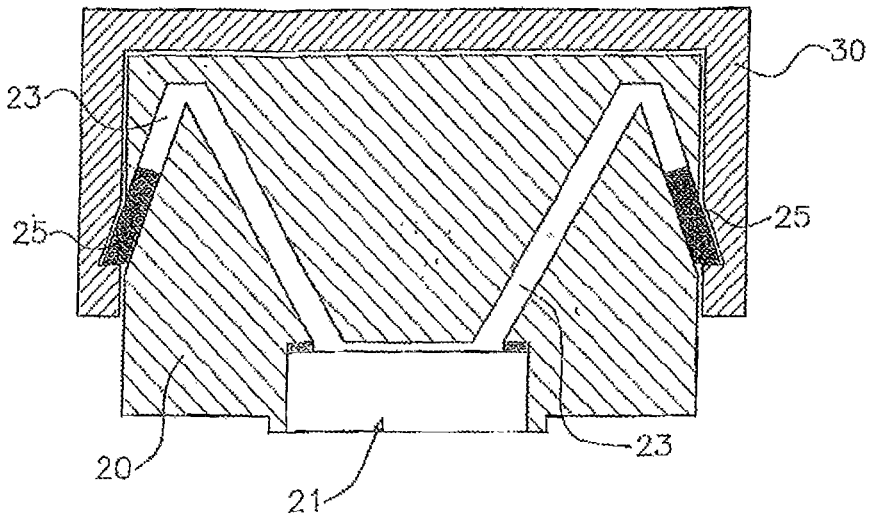
FIG. 1, illustrates a cross sectional diagram of a preferred embodiment of a smoke alarm according to the invention.

The following modes, given by way of example only, are described in order to provide a more precise understanding of the subject matter of a preferred embodiment or embodiments.

In the figures, incorporated to illustrate features of an example embodiment, like reference numerals are used to identify like parts throughout the figures.

Figure 1B:
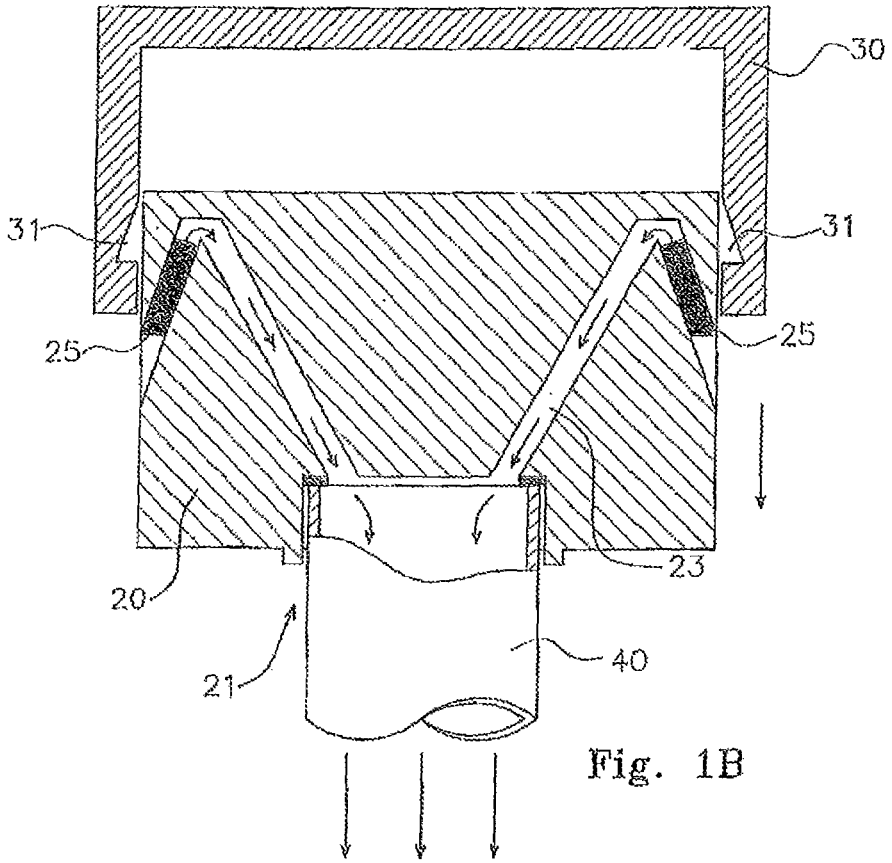

Referring to FIGS. 1A and 1B, cross sectional diagrams of a preferred embodiment of a locking device 10 are shown for releasably securing a first component 20 to a second component 30. The first component 20 includes a first opening 21 and a second opening 22 that are connected by a conduit 23. The conduit 23 provides fluid communication between the first opening 21 and the second opening 22.

In the preferred embodiment the first component 20 is a smoke alarm and the second component 30 is a bracket. In other optional embodiments, the first and second components 20, 30 may foe any other components or objects that need to be releasably secured to each other. For example, the components may be cupboard doors being secured to one another, a cupboard door being secured to a door frame, a drawer being secured in a closed position, a fitting such as a light or decoration being secured to a ceiling or wall, or a storage device for securing or hanging items out of the way.

In the preferred embodiment a pin 25 is located at least partially inside the conduit 23 and protrudes from the second opening 22 when in an extended position as shown in FIG. 1A. The pin is in the extended position when the locking device 10 in a locked position. The pin 25 can be retracted so that it is more substantially inside the conduit 23, this being a retracted position of the pin as shown in FIG. 1B and may be referred to as a released position of the locking device 10, In the refracted position the pin 25 may be entirely within the conduit 23, or may still protrude slightly from the second opening 22, but to a lesser extent than when in the extended position.

The second component 30 includes a recess 31. When the locking device 10 is in the locked position the pin 25 is partially inside the recess 31 as best seen in FIG. 1B, thereby preventing the first component 20 being removed from the second component 30. By moving the pin 25 to the retracted position, further into the conduit 23 as is the case in the released position, the pin 25 is removed from the recess 31. This allows the first component 20 to be removed from the second component 30.

The pin 25 can be moved into the retracted position by providing a region of low air pressure 41 at the first opening 21. Preferably, this region of low air pressure 41 is provided via a vacuum cleaner wand 40 inserted into the opening 21. The first opening 21 and the second opening 22 are in fluid communication, thereby transferring the low air pressure to an end of the pin 25, since it is located in the second opening 22. The low air pressure moves the pin 25 into the conduit 23, into the retracted position, so that the locking device 10 is now in the released position.

When the region of low air pressure 41 is removed, such as by turning off the vacuum cleaner 40, the pin 25 falls back into the extended position due to the force of gravity. If the first component 20 and second component 30 are in the appropriate positions relative to one another at this time this results in the locking device 10 being in the locked position.

In alternative embodiments, a biasing means may be included to bias the pin 25 towards the extended position. This would allow different arrangements of the locking device 10 where gravity does not cause the pin 25 to move to the extended position, such as a horizontally facing pin 25. Similarly, it would allow the first component 20 to be mounted at any angle, such as a smoke alarm being mounted to a wall rather than a ceiling. The biasing means could include, but is not limited to, magnets, coil springs, resilient material, or any other suitable spring.

The biasing means is particularly important if the locking device 10 is being used to retain cupboard doors. The orientation required in such a situation will often mean it is not possible to arrange the locking device 10 so that the pin 25 will return to the extended position under the force of gravity alone.

The operation of the locking device 10 may be improved by limiting the air flow past the pin 25. This can be accomplished by for example, but not limited to, providing a bushing, gasket, washer, o-ring or other sealing mechanism between the pin 25 and the conduit 23 or between the pin 25 and the second opening 22. This will help to ensure that the low pressure region 41 woks to retract the pin 25. Rather than air simply flowing in from the second opening 22 and past the outside of the pin 25.

An advantage of using a vacuum cleaner 40 to release the locking device 10 is that it allows for easy retrieval of the first component 20. For example, long rigid extension pieces or wands 40, are common on vacuum cleaners, thereby allowing the first component 20 to be removed even from a high ceiling without the need for a step or ladder. As shown in FIGS. 1A and 1B, the first opening 21 is preferably in the form of a socket adapted for insertion of the end of a vacuum cleaner wand 40 sufficient to support the smoke alarm 20 on the end of the wand.

In an example embodiment, the locking device 10 is arranged so that an entire smoke alarm is released from a bracket on a ceiling, thereby allowing for a battery in the smoke alarm to be changed or the smoke alarm to be cleaned, inspected and/or tested. The retaining bracket 30, meanwhile, would be permanently fixed to the ceiling. Preferably, this would he a very simple item that does not require maintenance.

In another example embodiment, the first component 20 may be a storage device to which clothes or other items can be attached, and the second component 30 may be a bracket. Again, the storage device can be secured to the bracket even in a position that would normally he very difficult to reach, thanks to vacuum cleaner extensions that are commonly available. This allows for items to be stored in positions that would otherwise be very inconvenient, thereby providing a means for utilising extra space in a home or other building.

Smoke alarms are commonly wired to a source of mains power with a battery provided only as backup. In an example embodiment, this connection may be provided by the pin 25 and a contact in the recess 31, or alternatively by some other system, of contacts in the smoke alarm and bracket that provide an electrical connection when the smoke alarm is locked in place in the bracket, while not preventing the smoke alarm from being removed.

When the first component 20 is released from the second component 30, it will ideally remain attached to the vacuum cleaner wand 40, thereby allowing the first component 20 to be safely lowered without damage to the first component 20 or the first component 20 failing and injuring a person. The first component 20 can be removed from the end of the vacuum cleaner wand 40 when appropriate by providing sufficient force—or by simply turning off the vacuum cleaner.

A seal 26 is provided at the opening 21 on the first component 20 that assists in providing the low pressure region 41. This may include a sealing surface that aids with sealing to a typical vacuum cleaner attachment. It may also include an attachment, such as a cylindrical section, that allows a vacuum cleaner 40 to be connected directly.

Returning the first component 20 to the locked position can be achieved by turning on the vacuum cleaner 40 and attaching the first component 20 to the wand 40. This allows the fir at component 20 to be safely raised or moved into position, while also holding the pin 25 in the retracted position. Once the first component 20 is in an appropriate position, the vacuum cleaner 40 can be turned off, allowing the pin 25 to move into an extended position and thereby locking device 10 into a locked position to component 30.

Alternatively, the locking device 10 may be arranged so that it can be pushed into place without the need for the low pressure region 41 to retain the pin 25 in the retracted position. In other words, the pin 25 can be pushed into the retracted position by the second component 30 as the first component 20 is inserted towards the locked position. When the appropriate position is reached the pin 25 will automatically move to the extended position due to gravity or the biasing means, such that the pin 25 is in the recess 31 and therefore the locking device 10 is in the looked position.

Another example embodiment includes a smoke alarm with two or more of the locking devices 10. Two locking devices 10 will generally be sufficient, however three or more may provide a more secure retention of the smoke alarm and provide backup in the event that one or more of the locking devices 10 fail. In such an embodiment with two or more locking devices 10, the locking devices may be completely independent, or alternatively may share certain portions. For example, an embodiment may include a single first opening 21 that is connected by a conduit 23 to two separate second openings 22, where a pin 25 protrudes from each of the second openings 22.

In an alternative embodiment, the first component 20 may only be a protective cover of a smoke alarm and the second component 30 may be a permanently fixed main body of a smoke alarm.

Figure 2:
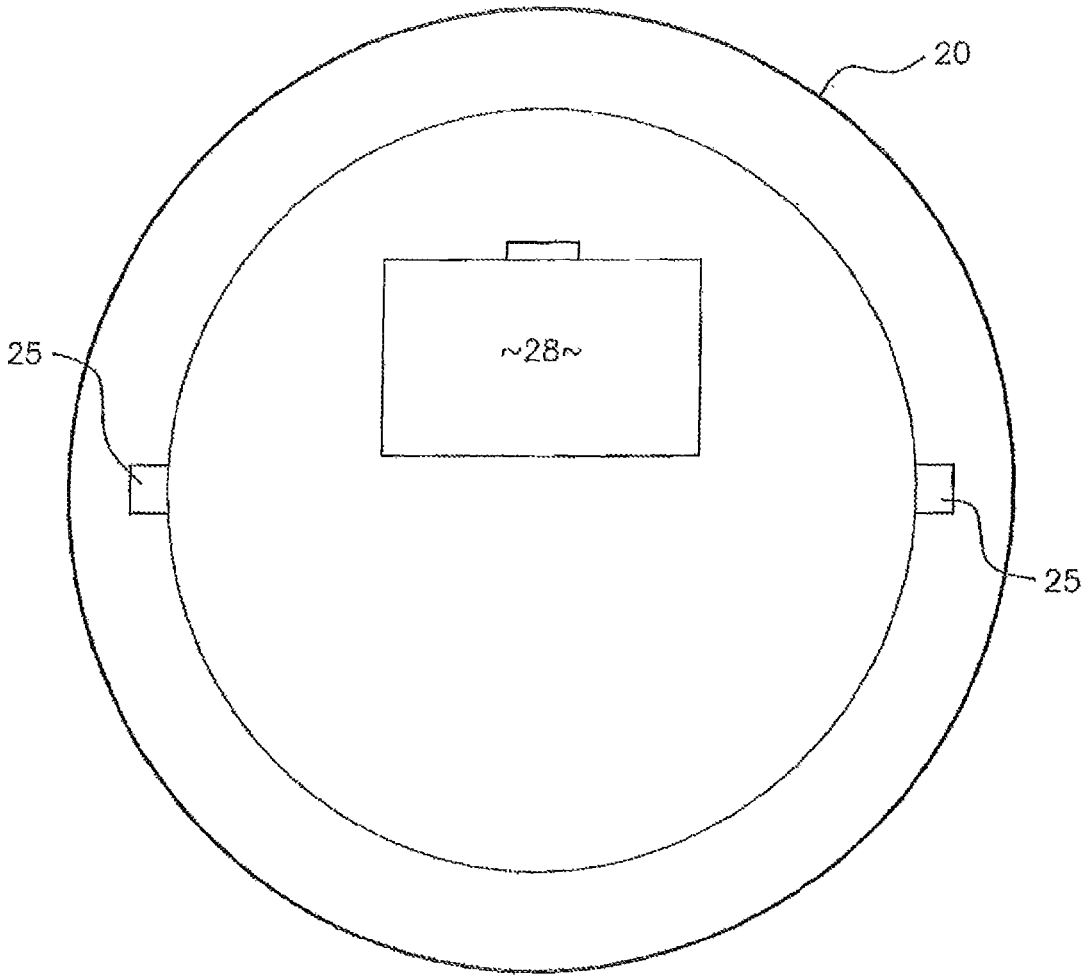
FIG. 2 illustrates a top view of a smoke alarm removed from a supporting bracket showing pins of a locking device according to an embodiment of the invention in an extended position.

Referring to FIG. 2, an example embodiment is shown of a first component 20 that has been constructed by modifying a prior art smoke alarm. Pins 25 can be seen protruding from the sides of the first component 20 and a battery 28 is shown, illustrating that by removing the first component 20 the battery 28 can be easily accessed.

Figure 3:
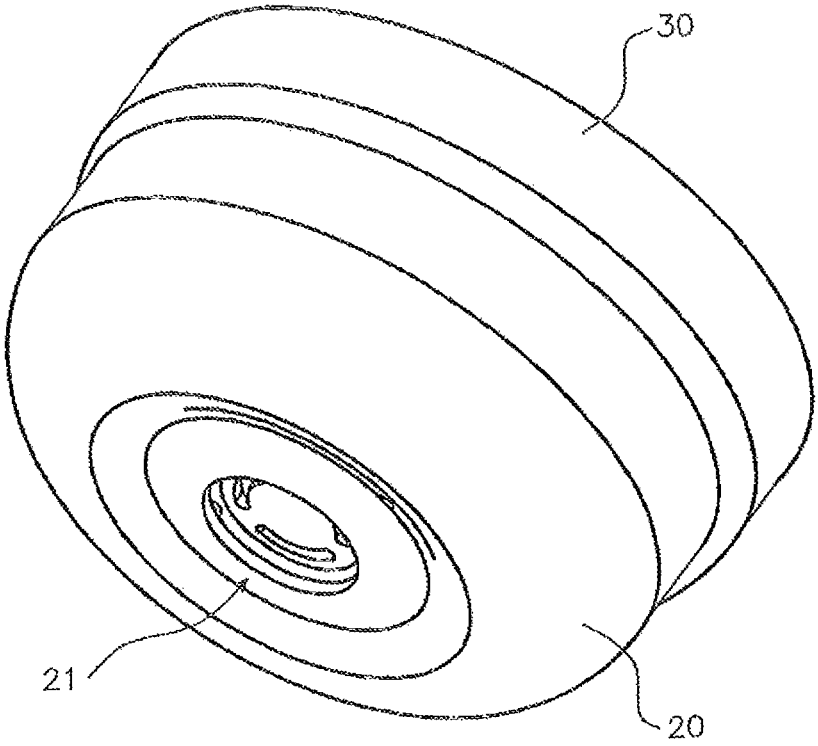
FIG. 3 is a perspective of the smoke alarm of FIGS. 1 and 2 locked to the supporting bracket.
Figure 4:
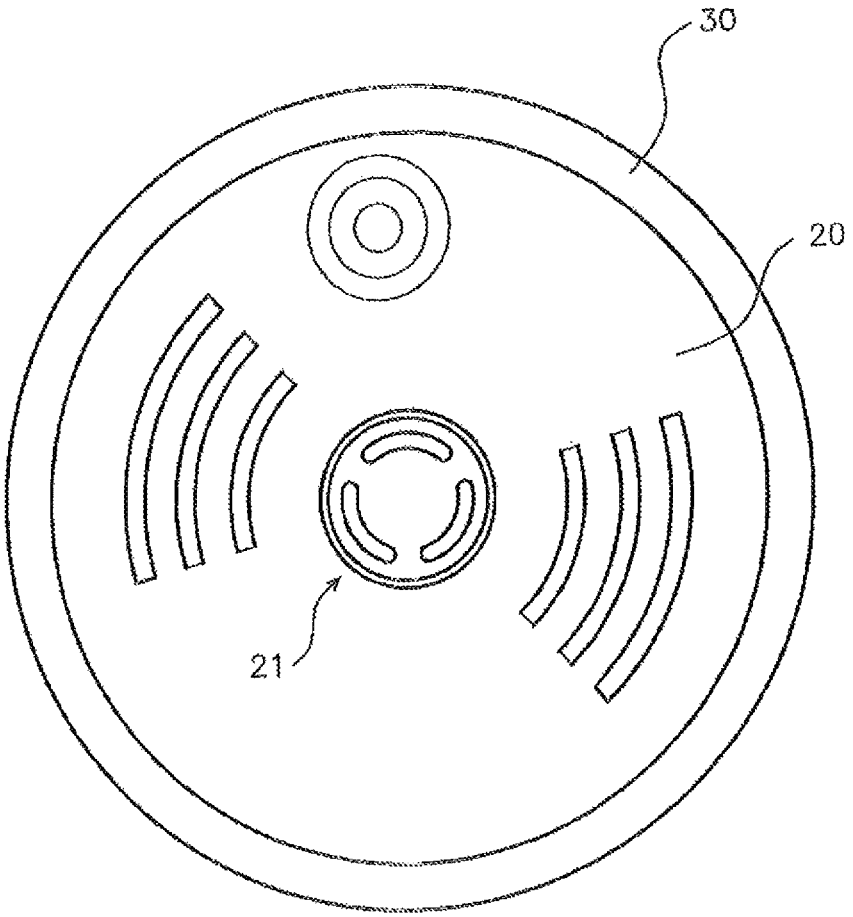
FIG. 4 illustrates a bottom view of an embodiment in a locked position within a bracket, FIGS. 5 and 6 axe perspective and face views respectively of a further embodiment of a smoke alarm according to the invention.

Referring to FIG. 3, an embodiment is shown of a first component 20 in the locked position inside a bracket, or second component 30. FIG. 4 shows a different view of the embodiment of FIG. 3. In FIG. 4, two instances of the first opening 21 can be seen on the outer surface 26 of the first component 20.

Figure 5:
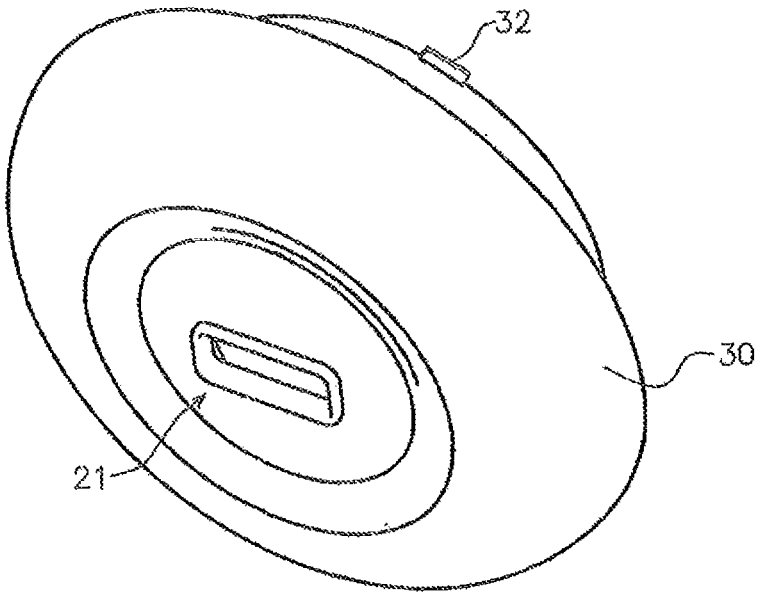
Figure 6:
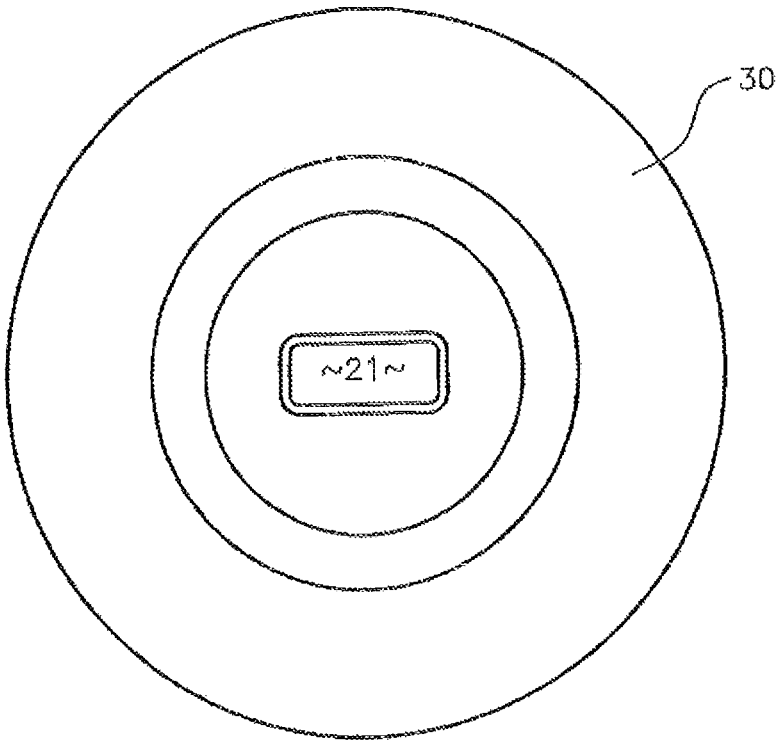

Referring now to FIGS. 5 and 6, in a further preferred embodiment according to the invention, the opening 21 in this instance is of a rectangular cross section. The rectangular section slot of the opening 21 is adapted to receive the rectangular section wand attachment (not shown) commonly provided with vacuum cleaners.

Figure 7:
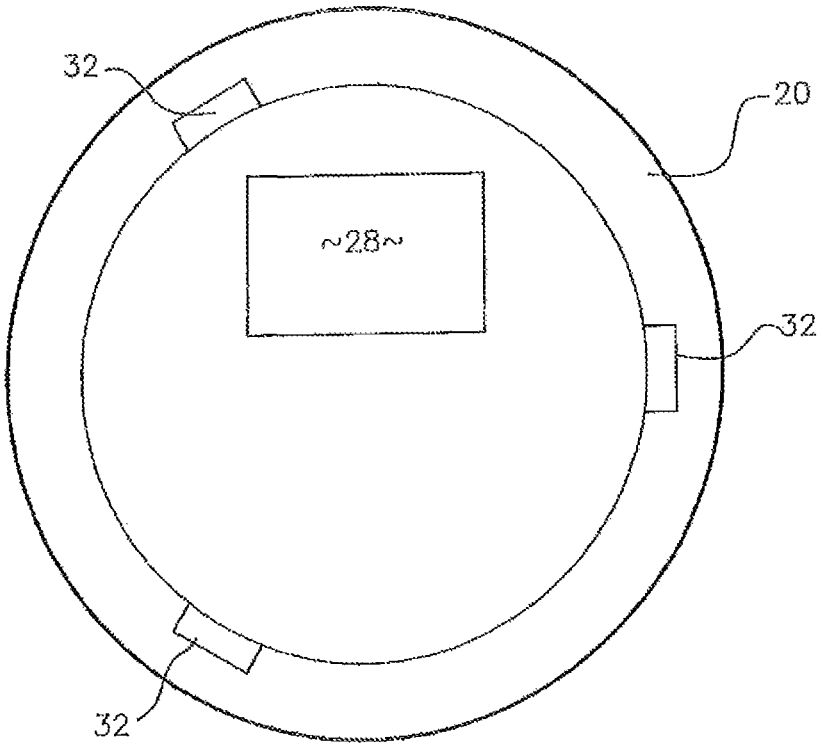
FIGS. 7 and 8 are perspective and face views respectively of another preferred embodiment of a smoke alarm according to the invention.
Figure 8:
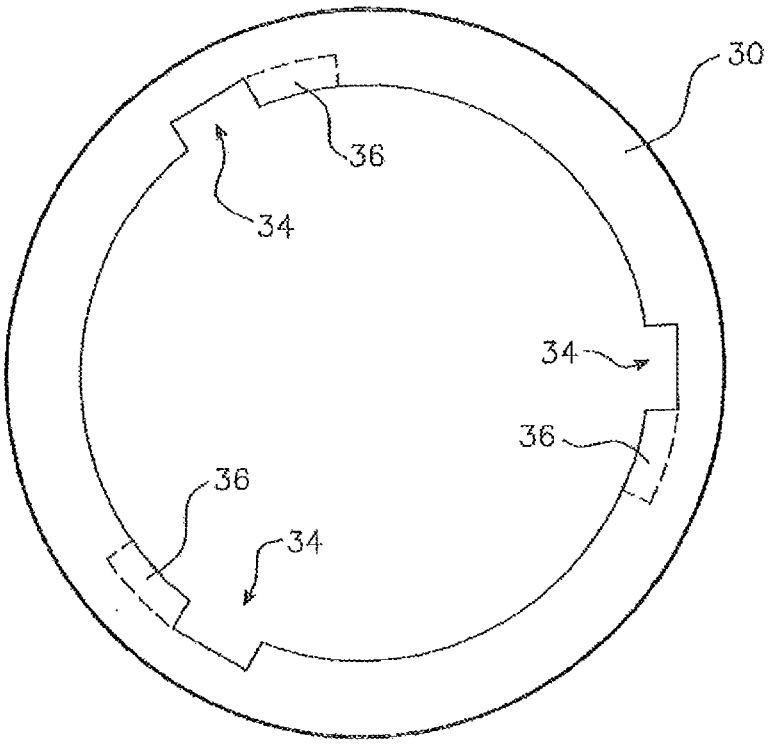

In this embodiment of the invention, the smoke alarm 20 may be retained in a locked position in bracket 30 by a bayonet type connection, in which the smoke alarm body is provided with at least two, preferably three projections 32 as shown in FIG. 7, for inserted and rotated connection with corresponding openings 34 and ledges 36 in the bracket 30 shown in FIG. 8.

In this arrangement the vacuum cleaner wand and the attachment serve only to allow a user standing on a floor surface below the smoke alarm of this embodiment, to reach and insert the wand attachment into the opening 21. To release the smoke alarm 30 from the bayonet connection with the bracket 30, the user need only apply sufficient rotation to the wand (and thus its attachment) to bring the projections 32 into alignment with the openings 34 to release and lower the smoke alarm to within reach. In each embodiment of the invention, the hole in the smoke alarm body accesses a socket of sufficient depth to support a smoke alarm on the end of an elongate implement inserted into the socket to safely lower or raise a smoke alarm body by means of the elongate implement.

Figure 9:
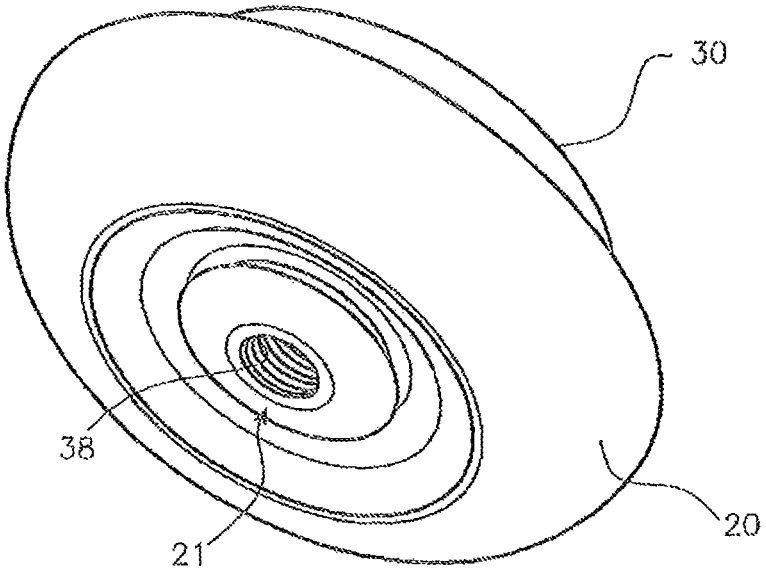
FIG. 9 is a perspective view of another preferred embodiment of a smoke alarm and release system according to the invention.
Figure 10:
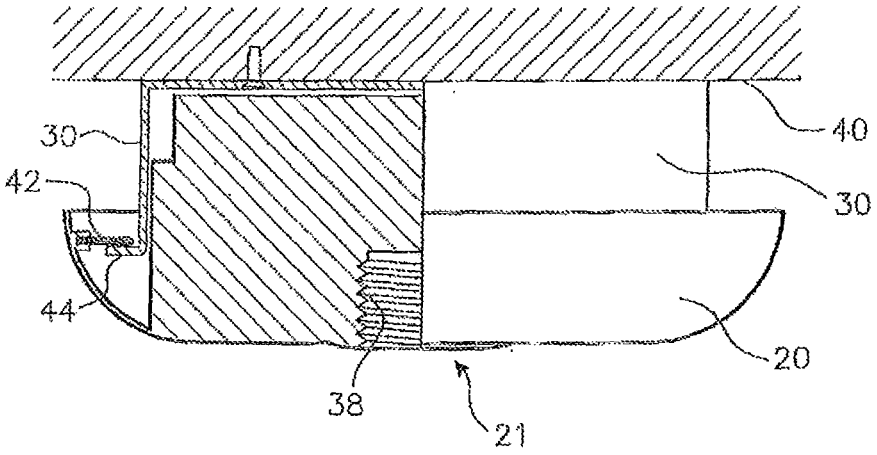
FIG. 10 is a cross section view of the smoke alarm of FIG. 9.

FIGS. 9 and 10 show another preferred embodiment of a smoke alarm release system in which the opening 21 accesses a threaded socket. The thread 38 of the socket conforms to the thread of a threaded stud at the outer end of an elongate implement which is a handle of a household device, such as commonly used on cleaning devices adapted for engagement with interchangeable cleaning heads or other implements. Typical examples are brooms, mops, "turks heads", window wipers and gardening tools for example.

The threaded socket allows a user standing on a floor surface below a smoke alarm 20, retained in a bracket 30 attached to an overhead surface 40, to screw the threaded end of the elongate implement (not shown) into the socket. In this embodiment, as shown in FIG. 10, the smoke alarm 20 is provided with an annular flexible ring 42 while the bracket 30 is formed with an annular projecting flange 44. Alternatively, the flexible ring could be provided in the bracket and the smoke alarm body formed with a projecting flange.

Flexible ring 42 is of sufficient stiffness to support the weight of smoke alarm 20, but is also sufficiently flexible to allow the smoke alarm to be pulled through the ring 42 by a downward force applied to an elongate implement, either the handle with threaded end screwed to a threaded socket, or a vacuum cleaner wand applying sufficient vacuum force to pull the alarm body free of the flexible ring.

Alternatively, the arrangement of a threaded socket shown in FIG. 9, could also be used to disconnect a smoke alarm, and bracket assembly interconnected by the bayonet system described above.

Figure 11:
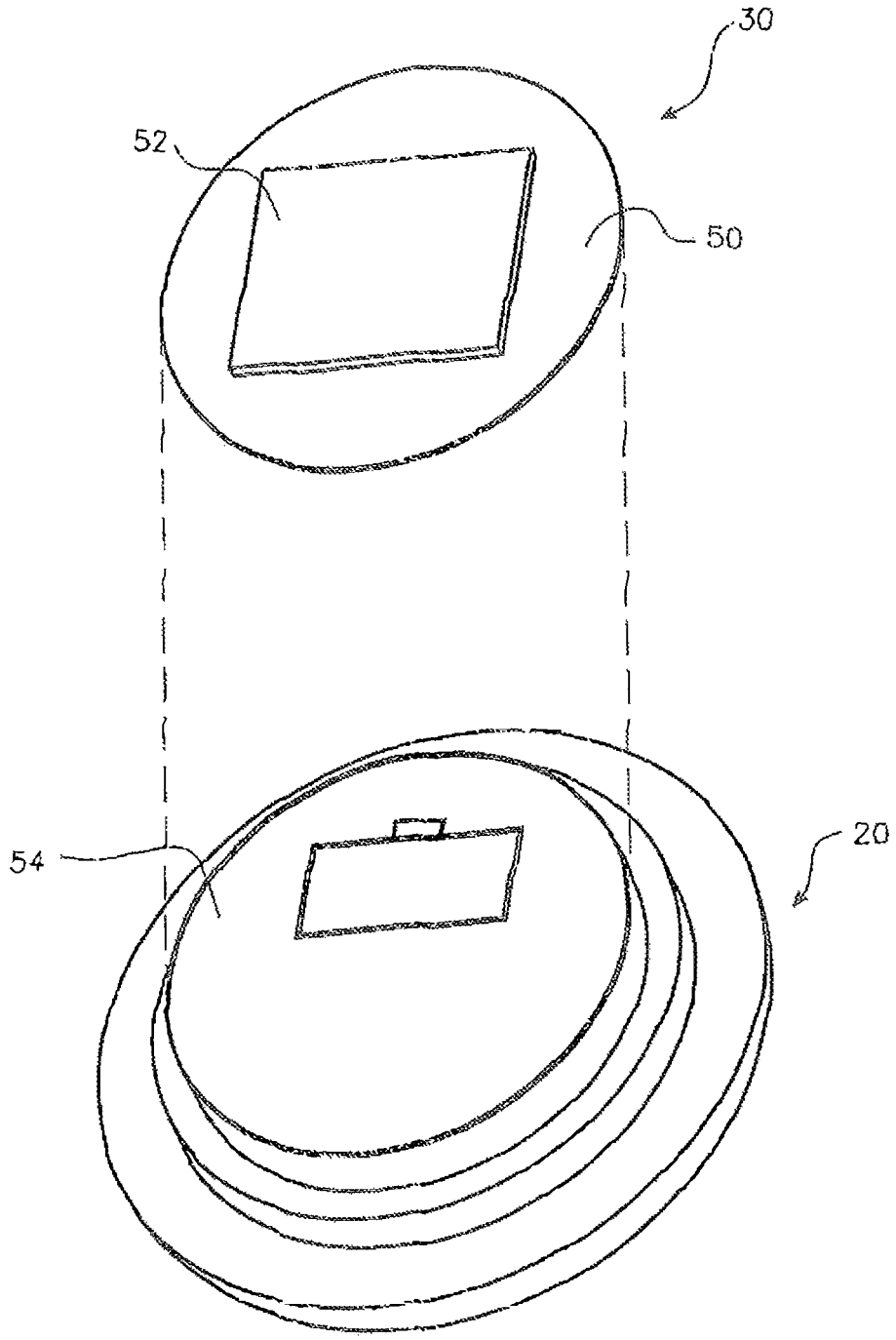
FIG. 11 illustrates an alternative preferred form of supporting element in the form of a magnetic plate.

In still a further preferred embodiment with reference to FIG. 11, the supporting element or bracket 30 is simply comprised of a magnetic plate 50 substantially conforming in size to the top side of the smoke alarm 20. The magnetic plate 50 may be attached to the overhead surface by screws, by an adhesive or, more preferably, by means of double sided adhesive tape 52. The top surface of the smoke alarm 20 is likewise provided with a magnetic plate 54 conforming to the plate comprising the supporting bracket. The adhesive strength of the double sided tape 52 and the magnetic strength of the plates 50 and 54 are such as to securely support the assembly of bracket and smoke alarm at the overhead surface by magnetic attraction.

A user may disengage the smoke alarm 20 from the bracket 30 of this embodiment, by applying any of the elongate implements described above, that is, the wand of a vacuum cleaner or attachment if the opening is cylindrical or rectangular in section, or the threaded stud end of a handle for a smoke alarm with a threaded socket. The smoke alarm can then be slid sideways off the plate of the bracket and lowered to within reach of a user.

It will be understood that the use of double sided adhesive tape may equally be used to affix a non magnetic smoke alarm supporting bracket to an overhead surface. Again the double sided adhesive tape is applied to the upper surface of the bracket, the upper adhesive surface of the tape exposed and the bracket mounted to an elongate implement and raised and pressed into contact with the overhead surface. In this case the bracket may employ any of the smoke alarm body retaining arrangements described above, such as the bracket with vacuum actuated pins, the bracket with the flexible annular retaining ring or that with the bayonet type connection.

Any of the above described embodiments allows for the servicing or inspection of a smoke alarm by a user standing on a floor surface below a smoke alarm attached to a bracket mounted to an overhead surface, without the need to climb up to the smoke alarm.

The last described embodiment above has an additional advantage in that it permits of the smoke alarm and bracket assembly to be mounted to the overhead surface without the need to climb up to the surface. As noted above, the bracket may be prepared by attaching the first side of the double adhesive tape to the upper surface of the bracket and removing the protective cover from the upper surface of the tape. The bracket is then connected to the body of the smoke alarm and the assembly attached to either the vacuum cleaner wand or the elongate handle, raised to, and pressed against, the desired location on the overhead surface, securing the bracket and smoke alarm to the surface.

The invention claimed is:

1. A method of mounting and dismounting a smoke alarm, the method comprising the steps of:

a. providing a smoke alarm body adapted for detachable attachment to a supporting element mountable to an overhead surface, the smoke alarm body providing an opening;

b. inserting an elongate implement into the opening; and c. applying a low air pressure force to the opening via the elongate implement, the low air pressure force acting to secure the smoke alarm body to the elongate implement.

2. The method of claim 1, including the step of mounting or dismounting the smoke alarm body to/from the supporting element via the elongate element while the low air pressure force secures the smoke alarm body to the elongate element.

3. The method of claim 2, wherein the elongate implement is a wand or wand attachment of a vacuum cleaner.

4. The method of claim 3, wherein the smoke alarm body is connected to the supporting element by a retaining mechanism, the retaining mechanism comprising a bayonet connection, wherein the smoke alarm body is adapted to be released from the supporting element by sequentially applying a turning force and a downward force to the elongate implement.

5. The method of claim 1, wherein the smoke alarm body is connected to the supporting element by a retaining mechanism, the retaining mechanism having (i) a retaining state for mounting the smoke alarm body to the supporting element and (ii) a released state for dismounting the smoke alarm body from the supporting element, the low air pressure force acting to move the retaining mechanism form the retaining state to the released state.

6. The method of claim 5, wherein the retaining mechanism includes retractable pins extending from the smoke alarm body to engage with corresponding recesses in the supporting element, the pins being retractable into a non-engaging position when the low air pressure force is applied to the opening.

7. The method of claim 1, wherein (i) the smoke alarm body at an upper surface includes a magnetic body and (ii) the supporting element includes a magnetic body for attachment to the magnetic body of the smoke alarm body, the smoke alarm body adapted to be dismounted from the supporting element by a sideways force applied to the elongate implement by a user.

8. A smoke alarm mountable to an overhead surface, the smoke alarm comprising (i) a supporting element mountable to the overhead surface and (ii) an alarm body adapted for detachable attachment to the supporting element, the alarm body including an opening adapted to receive an end of an elongate implement, the alarm body operatively adapted to be secured to the elongate implement upon the application by the implement of a low air pressure force to the opening, in use securing the alarm body to the elongate element assisting mounting or dismounting of the alarm body from the supporting element.

9. The smoke alarm of claim 8, wherein the opening is adapted to receive a wand or wand attachment of a vacuum cleaner, the low air pressure force being a partial vacuum created by the vacuum cleaner when the wand or wand attachment is inserted into the opening.

10. The smoke alarm of claim 8, wherein the smoke alarm body is connectable to the supporting element by a retaining mechanism, the retaining mechanism having (i) a retaining state for mounting the smoke alarm body to the supporting element and (ii) a released state for dismounting the smoke alarm body from the supporting element, in use the low air pressure force acting to move the retaining mechanism form the retaining state to the released state.

11. The smoke alarm of claim 10, wherein the retaining mechanism includes retractable pins extending from the smoke alarm body to engage with corresponding recesses in the supporting element, the pins being retractable into a non-engaging position when the low air pressure force is applied to the opening.

12. The smoke alarm of claim 8, wherein the smoke alarm body is connectable to the supporting element by a retaining mechanism, the retaining mechanism comprising a bayonet connection, the smoke alarm body operatively adapted to be released from the supporting element by application to the smoke alarm body by the elongate implement of a sequential turning force and downward force.

13. The smoke alarm of claim 8, wherein (i) the smoke alarm body at an upper surface includes a magnetic body and (ii) the supporting element includes a body adapted for magnetic attachment to the magnetic body of the smoke alarm body, the smoke alarm body adapted to be dismounted from the supporting element by a sideways force applied to the elongate implement by a user.

* * * * *